US012312541B2

(12) United States Patent
Subramaniyam et al.

(10) Patent No.: US 12,312,541 B2
(45) Date of Patent: May 27, 2025

(54) COKE REDUCING ADDITIVE COMPOSITION AND METHOD OF USE THEREOF

(71) Applicant: Dorf Ketal Chemicals (India) Private Limited, Mumbai (IN)

(72) Inventors: Mahesh Subramaniyam, Singapore (SG); Shivank Menon, Mumbai (IN); Prasanta Barua, Mumbai (IN); Suhas A. Chavan, Mumbai (IN)

(73) Assignee: Dorf Ketal Chemicals (India) Private Limited, Mumbai (IN)

( * ) Notice: Subject to any disclaimer, the term of this patent is extended or adjusted under 35 U.S.C. 154(b) by 0 days.

(21) Appl. No.: 18/841,218

(22) PCT Filed: Jul. 14, 2023

(86) PCT No.: PCT/IB2023/057234

§ 371 (c)(1),
(2) Date: Aug. 23, 2024

(87) PCT Pub. No.: WO2024/018346

PCT Pub. Date: Jan. 25, 2024

(65) Prior Publication Data

US 2025/0109339 A1 Apr. 3, 2025

(30) Foreign Application Priority Data

Jul. 20, 2022 (IN) ..... 202221041644

(51) Int. Cl.

| | |
|---|---|
| ***C10G 1/10*** | (2006.01) |
| ***C07C 65/11*** | (2006.01) |
| ***C07H 11/04*** | (2006.01) |
| ***C10B 57/06*** | (2006.01) |

(52) U.S. Cl.

CPC ..... *C10G 1/10* (2013.01); *C10B 57/06* (2013.01); *C10G 2300/1003* (2013.01); *C10G 2300/1077* (2013.01); *C10G 2300/80* (2013.01)

(58) Field of Classification Search

CPC ..... C10G 1/10; C10G 2300/1003; C10G 2300/1077; C10G 2300/80; C10B 57/06; C07C 65/11; C07H 11/04

See application file for complete search history.

(56) References Cited

U.S. PATENT DOCUMENTS

| | | | |
|---|---|---|---|
| 4,409,093 A | 10/1983 | Bearden, Jr. | |
| 5,128,023 A | 7/1992 | Reid | |
| 5,858,208 A | 1/1999 | Flanders | |
| 6,387,840 B1 | 5/2002 | Salazar | |
| 10,745,629 B2 | 8/2020 | Kohli | |
| 2021/0087473 A1 | 3/2021 | Pradeep | |
| 2023/0145975 A1* | 5/2023 | Subramaniyam | C10B 43/14 585/241 |

FOREIGN PATENT DOCUMENTS

| | | | |
|---|---|---|---|
| EP | 0672744 | A1 | 9/1995 |
| RU | 2721849 | C1 | 5/2020 |
| WO | 1995014069 | A1 | 5/1995 |
| WO | 2004104139 | A1 | 12/2004 |
| WO | 2008122989 | A2 | 10/2008 |

OTHER PUBLICATIONS

S. Vaish and D. Kunzru, Triphenyl Phosphite as a Coke Inhibitor During Naphtha Pyrolysis, 28 Ind. Eng. Chem. Res. 1293-1299 (1989).*

P. Das et al., Organophosphorus Compounds as Coke Inhibitors During Naphtha Pyrolysis—Effect of Benzyl Diethyl Phosphite and Triphenylphosphine Sulfide, 31 Ind. Eng. Chem. Res. 2251-2255 (1992).*

Foreign Communication from Related Application—International Search Report and Written Opinion of the International Searching Authority, International Application No. PCT/IB2023/057234, dated Jan. 25, 2024 9 pages.

* cited by examiner

*Primary Examiner* — Randy Boyer
(74) *Attorney, Agent, or Firm* — Conley Rose, P.C.; Rodney B. Carroll

(57) ABSTRACT

In one embodiment, the present invention relates to a coke reducing additive composition for simultaneously: reducing coke formed and increasing distillate during processing of: plastic material, or feedstock, or a combination of the plastic material and the feedstock, wherein the coke reducing additive comprises a combination at least of:

a) diisodecyl phenyl phosphite (DIDPP); and
b) metal salt including calcium salt, sodium salt, calcium salt of organic acid, sodium salt of organic acid or a mixture thereof;
wherein the calcium salt is calcium naphthanate (CaNaphthenate); and
wherein the sodium salt is Sodium naphthanate (NaNaphthenate).

In the alternate embodiments, the present invention also relates to a method for simultaneously: reducing coke formed and increasing distillate; and a method of using a coke reducing additive composition for simultaneously: reducing coke formed and increasing distillate during processing of: plastic material, or feedstock, or a combination of the plastic material and the feedstock.

In yet another alternate embodiments, the present invention also relates to a method for converting a waste plastic material to a distillate (a useful chemical commodity); and a method for reducing formation of coke deposits on walls of a processing unit, and a method for reducing fouling caused due to deposits of coke products on walls of the processing unit.

17 Claims, No Drawings

COKE REDUCING ADDITIVE COMPOSITION AND METHOD OF USE THEREOF

CROSS-REFERENCE TO RELATED APPLICATIONS

This application is a filing under 35 U.S.C. 371 as the National Stage of International Application No. PCT/IB2023/057234 filed Jul. 14, 2023 and entitled "Coke Reducing Additive Composition and Method of Use Thereof", which claims priority Indian Patent Application number 202221041644 filed Jul. 20, 2022, which are hereby incorporated by reference in their entirety.

FIELD

Firstly, the present invention is not for the purpose of defence.

The present invention relates to a coke reducing additive composition and method of use thereof.

Particularly, in one embodiment, the present invention relates to a coke reducing additive composition for reducing coke formed and simultaneously increasing distillate during processing of plastic material with or without feedstock, wherein the coke reducing additive composition comprises a combination at least of:

a) diisodecyl phenyl phosphite (DIDPP); and b) metal salt including calcium salt, sodium salt, calcium salt of organic acid, sodium salt of organic acid or a mixture thereof;

wherein the calcium salt is calcium naphthanate (CaNaphthenate); and wherein the sodium salt is sodium naphthanate (NaNaphthenate).

Particularly, in another embodiment, the present invention relates to a method for reducing coke formed and simultaneously increasing distillate during processing of plastic material with or without feedstock, wherein the method comprises a step of adding a coke reducing additive composition of the present invention in a processing unit processing the plastic material with or without the feedstock.

Particularly, in still another embodiment, the present invention relates to a method of use of a coke reducing additive composition for reducing coke formed and simultaneously increasing distillate during processing of plastic material with or without feedstock, wherein the method of use comprises a step of treating the plastic material with or without the feedstock with the coke reducing additive composition of the present invention in a processing unit processing the plastic material with or without the feedstock.

Particularly, in yet another embodiment, the present invention relates to a method for reducing formation of coke deposits on walls of the processing unit by employing the coke reducing additive composition of the present invention.

Particularly, in yet another embodiment, the present invention relates to a method for reducing fouling caused due to deposits of coke products on walls of the processing unit by employing the coke reducing additive composition of the present invention.

BACKGROUND

Coke is produced during feedstock comprising vacuum residue (VR) pyrolysis. Coke is also produced during processing of plastic material comprising olefin polymer (OP), including polypropylene plastic (PP) material. Coke is also produced during processing of plastic material comprising olefin polymer (OP), including polypropylene plastic (PP) material in combination with (or in presence of) feedstock comprising vacuum residue (VR). Coke is also produced during cracking of hydrocarbon feedstock.

The coke formed during the feedstock pyrolysis, or during the processing of plastic material, or during processing of plastic material in combination with (or in presence of) feedstock, or during the cracking of the hydrocarbon feedstock may be referred to as pyrolytic coke which gets formed and deposited on metal surfaces in contact with the feedstock and/or the plastic material undergoing pyrolytic or cracking processing. The coke formation is, therefore unavoidable part of a thermal pyrolysis or cracking process, and is undesirable. Furthermore, with the coke formation, the amount of distillate formed gets reduced.

The U.S. Pat. No. 10,745,629 to Kirtika Kohli et al discloses a process for processing vacuum residues, but the disclosure and teaching of this patent are limited to process for making a waste plastic as a hydrogen donating agent for hydro-conversion of heavy crude oil and vacuum residues.

The US patent publication no. US 2021/087473A1 to Pradeep et al discloses a process for conversion of a waste plastic into lighter distillate products by thermal cracking of a mixture of a fresh hydrocarbon feedstock and the waste plastic to obtain a light Coker gasoil, a heavy Coker gasoil and a coke fuel oil along with a vapor fraction and separating into fuel gas, LPG and naphtha.

The U.S. Pat. No. 4,409,093 to Roby Bearden, Jr. et al discloses a method for decreasing the amount of coke produced during the cracking of hydrocarbon feedstock to lower molecular weight products by processing a feedstock containing at least two metal contaminants selected from the class consisting of Ni, V, and Fe to avoid formation of deposits of these contaminants on the catalyst by partially passivating the catalyst.

The U.S. Pat. No. 5,128,023 to Dwight K. Reid et al discloses a method and compositions for inhibiting the formation and deposition of pyrolytic coke on metal surfaces in contact with a hydrocarbon feedstock undergoing pyrolytic processing by adding a coke inhibiting amount of a combination of: a boron compound and a dihydroxybenzene compound, specifically ammonium biborate and hydroquinone in the presence of glycolic-type solvents and water along with a co-solvent such as butyl carbitol or ethylene glycol.

The U.S. Pat. No. 5,858,208 to Robert L. Flanders et al discloses a method for improving conversion during fluidized catalytic cracking of a feed stream containing vanadium by adding an effective amount of a composition comprising one overbase complex of a magnesium or aluminium salt and an organic acid (fatty acid) complexing agent, and an antimony compound.

The U.S. Pat. No. 6,387,840 to Salazar Ramon et al discloses an oil soluble additive for a coking feedstock to reduce coke formation and enhance distillate production in coking processes.

The WO 2004/104139 A1 to Exxonmobil Res & Eng Co., US: Siskin Michael et al discloses a delayed coking process comprising contacting a vacuum reside with an effective amount of at least one metal-containing additive.

The WO 1995/014069 A1 to Mobil Oil Corp, discloses a method for converting a waste plastic into a useful chemical commodity by pyrolysis of a plastic material.

However, the prior art is silent about a technical solution to the presently faced problems of: (i) increase in coke formation and (ii) simultaneous decrease in yield of the distillate during processing of a feedstock, or a plastic material, or a mixture of a feedstock and a plastic material.

The prior art is also silent about a technical solution to the presently faced problems of: conversion of a waste plastic into a useful chemical commodity, i.e., distillate during the processing of the waste plastic material.

The prior art is also silent about a technical solution to the presently faced problems of: reducing coke deposits on walls of a processing unit; and reducing fouling due coke deposit during the processing of a feedstock, or a plastic material, or a mixture of a feedstock and a plastic material.

Need of the Invention

Therefore, the industry desires to have a solution to the above discussed technical problem so as to have an additive composition and a method to simultaneously: reduce coke formation and increase distillate formation during processing of a feedstock, or a plastic material, or a mixture of a feedstock and a plastic material.

The industry also desires to have a solution to the above discussed technical problem of: conversion of a waste plastic into a useful chemical commodity, i.e., distillate during the processing of the waste plastic material.

The industry also desires to have a solution to the above discussed technical problems of: reducing coke deposits on walls of a processing unit; and reducing fouling due coke deposit during the processing of a feedstock, or a plastic material, or a mixture of a feedstock and a plastic material.

Problem to be Solved by the Invention

Accordingly, main aim of the present invention is to solve the above-discussed problems of the industry, i.e., increase in formation of coke and decrease in yield of distillate during processing of a plastic material, a feedstock, or a combination of a plastic material and a feedstock, by providing a coke reducing additive composition for reducing coke formation and simultaneously for increasing distillate formation during processing of a plastic material, a feedstock, or a combination of a plastic material and a feedstock.

Accordingly, another aim of the present invention is to solve the above-discussed problems of the industry, i.e., reducing formation of coke deposits on walls of the processing unit; and reducing fouling caused due to deposits of coke products on walls of the processing unit by providing the coke reducing additive composition of the present invention.

OBJECTS OF THE INVENTION

Therefore, main object of the present invention is to provide a coke reducing additive composition and a method of use thereof to reduce coke formation and simultaneously to increase distillate formation during processing of a plastic material, a feedstock, or a combination of a plastic material and a feedstock in a processing unit, wherein the processing unit may also be referred to as a coker unit, a pyrolytic furnace, a steam cracking furnace.

Accordingly, another object of the present invention is to provide a coke reducing additive composition and a method of use thereof to reduce coke formation and simultaneously to increase distillate formation during processing of olefin polymer (OP), including polypropylene plastic (PP) material with or without vacuum residue (VR), and during cracking of hydrocarbon feedstock.

Accordingly, still another object of the present invention is to provide a coke reducing additive composition for reducing formation of coke deposits on walls of the processing unit.

Accordingly, still another object of the present invention is to provide a coke reducing additive composition for reducing fouling caused due to deposits of coke products on walls of the processing unit.

Further objects and advantages of the present invention would be apparent from the following description of the invention.

DESCRIPTION OF THE INVENTION

With aim to solve the above-discussed problems of the prior art, the inventors have found that about 100 g of vacuum residue (VR) forms about 38.37 g of coke and about 42 g of distillate during vacuum residue (VR) pyrolysis (re Expt. No. 1 of Table-I), and about 100 g of polypropylene plastic (PP) material forms only about 0.9 g of coke and about 85.4 g of distillate during thermal pyrolysis (re Expt. No. 2 of Table-I). However, when the polypropylene plastic (PP) material is processed along with the vacuum residue (VR), then the coke formation increases substantially and distillate formation decreases substantially. For example, processing of combination of about 50 g of vacuum residue (VR) and about 50 g of polypropylene plastic (PP) material, surprisingly and unexpectedly, forms substantially increased amount of about 29.76 g of coke and substantially reduced amount of about 54.59 g of distillate during the processing of the polypropylene plastic (PP) material along with the vacuum residue (re Expt. No. 5 vis-à-vis Expt. No. 2 of Table-I). This is unexpected behaviour of the polypropylene plastic (PP) material when processed along with vacuum residue during the vacuum residue pyrolysis.

In order to solve the above-discussed problems of: (i) increase in formation of coke and (ii) simultaneously decrease in formation of distillate during processing of a plastic material, or a feedstock, or a combination of a plastic material and a feedstock in a processing unit, the inventors have found that an additive composition comprising at least a combination of:

(a) diisodecyl phenyl phosphite (DIDPP); and (b) metal salt including calcium salt, sodium salt, calcium salt of organic acid, sodium salt of organic acid or a mixture thereof, wherein the calcium salt is calcium naphthanate (CaNaphthenate); and wherein the sodium salt is Sodium naphthanate (NaNaphthenate);

surprisingly and unexpectedly, reduces the coke formation and simultaneously increases the distillate formation during the processing of the plastic material, the feedstock, or the combination of the plastic material and the feedstock in a processing unit.

Therefore, in accordance with the present invention, during processing of the plastic material, or the feedstock, or the combination of the plastic material and the feedstock, the amount of coke (undesirable commodity) formed is reduced and simultaneously the amount of distillate (a useful chemical commodity) formed is increased by employing the additive composition, which is referred herein as the coke reducing additive composition of the present invention.

Therefore, in accordance with the present invention, during processing of the plastic material, or the combination of the plastic material and the feedstock, the amount of coke (undesirable commodity) formed is reduced and simultaneously the amount of distillate (a useful chemical commodity) formed is increased by employing the coke reducing additive composition of the present invention, the waste plastic material is therefore converted into a useful chemical commodity.

Therefore, in accordance with the present invention, during processing of the plastic material, or the combination of the plastic material and the feedstock, the amount of coke (undesirable commodity) formed is reduced and simultaneously the amount of distillate (a useful chemical commodity) formed is increased by employing the coke reducing additive composition of the present invention, the formation of coke deposits on walls of the processing unit is therefore reduced.

Therefore, in accordance with the present invention, during processing of the plastic material, or the combination of the plastic material and the feedstock, the amount of coke (undesirable commodity) formed is reduced and simultaneously the amount of distillate (a useful chemical commodity) formed is increased by employing the coke reducing additive composition of the present invention, the fouling caused due to deposits of coke products on walls of the processing unit is therefore reduced.

Accordingly, in first embodiment, the present invention relates to a coke reducing additive composition for reducing coke formed and simultaneously increasing yield of distillate formed during processing of a plastic material, or a feedstock, or a combination of a plastic material and a feedstock in a processing unit, wherein the coke reducing additive composition comprises at least a combination of:

(a) diisodecyl phenyl phosphite (DIDPP); and (b) metal salt including calcium salt, sodium salt, calcium salt of organic acid, sodium salt of organic acid or a mixture thereof, wherein the calcium salt is calcium naphthanate (CaNaphthenate); and wherein the sodium salt is Sodium naphthanate (NaNaphthenate).

Accordingly, in accordance with one of the preferred embodiments, the coke reducing additive composition of the present invention is suitable for processing a plastic material during pyrolytic or cracking processing of the material.

Accordingly, in accordance with one of the preferred embodiments, the coke reducing additive composition of the present invention is suitable for processing a feedstock during pyrolytic or cracking processing of the material.

Accordingly, in accordance with one of the preferred embodiments, the coke reducing additive composition of the present invention is suitable for processing a plastic material along with (or in combination with) a feedstock during pyrolytic or cracking processing of the material.

Accordingly, in accordance with one of the preferred embodiments, the plastic material comprises a waste plastic material, an olefin polymer (OP), a low-density polyethylene (LDPE), a high-density polyethylene (HDPE), a mix plastic, a polystyrene, a polypropylene plastic (PP), a polyethylene, or a mixture thereof, preferably a waste plastic material, an olefin polymer (OP), polypropylene plastic (PP) material.

Accordingly, in accordance with one of the preferred embodiments, the feedstock comprises crude oil, vacuum residue, atmospheric residue, asphalted pitch, shale oil, coal tar, clarified oil, residual oils, heavy waxy distillates, foots oil, slop oil, or mixture thereof, preferably a vacuum residue (VR).

Accordingly, in accordance with one of the preferred embodiments, the present invention relates to a coke reducing additive composition for simultaneously:

(a) reducing coke formation; and (b) increasing yield of distillate:

during pyrolytic or cracking processing of a material comprising:

(i) a feedstock:

(ii) a plastic material, or (iii) a plastic material in the presence of a feedstock:

wherein the coke reducing additive composition comprises at least a combination of:

a) diisodecyl phenyl phosphite (DIDPP); and b) metal salt including calcium salt, sodium salt, calcium salt of organic acid, sodium salt of organic acid or a mixture thereof:

wherein the plastic material comprises a waste plastic material, olefin polymer (OP) material, polypropylene plastic (PP) material, or a combination thereof:

wherein the feedstock comprises a vacuum residue (VR);

wherein the calcium salt is calcium naphthanate (CaNaphthenate):

wherein the sodium salt is Sodium naphthanate (NaNaphthenate).

Accordingly, in second embodiment, the present invention relates to a method for simultaneously: reducing coke formed and increasing distillate formed during processing of a plastic material, or a feedstock, or a combination of a plastic material and a feedstock in a processing unit, wherein the method comprises a step of adding the coke reducing additive composition of the present invention as described herein in a processing unit containing the plastic material, or the feedstock, or the combination of the plastic material and the feedstock.

Accordingly, in third embodiment, the present invention relates to a method of using a coke reducing additive composition for simultaneously: reducing coke formed and increasing distillate formed during processing of a plastic material, or a feedstock, or a combination of a plastic material and a feedstock in a processing unit, wherein the method comprises a step of treating the plastic material, or the feedstock, or the combination of the plastic material and the feedstock contained in the processing unit with the coke reducing additive composition of the present invention.

Accordingly, in accordance with one of the preferred embodiments, the coke reducing additive composition of the present invention is suitable for converting a waste plastic material to a distillate (a useful chemical commodity) during pyrolytic or cracking processing of the waste plastic material.

Accordingly, in fourth embodiment, the present invention relates to a method for converting a waste plastic material to a distillate (a useful chemical commodity), wherein the method comprises a step of treating the plastic material, or the feedstock, or the combination of the plastic material and the feedstock contained in the processing unit with the coke reducing additive composition of the present invention.

Accordingly, in accordance with one of the preferred embodiments, the coke reducing additive composition of the present invention is suitable for reducing formation of coke deposits on walls of a processing unit during pyrolytic or cracking processing of a plastic material, or a feedstock, or a combination of the plastic material and the feedstock.

Accordingly, in fifth embodiment, the present invention relates to a method for reducing formation of coke deposits on walls of a processing unit, wherein the method comprises a step of treating a plastic material, or a feedstock, or a combination of the plastic material and the feedstock contained in the processing unit with the coke reducing additive composition of the present invention.

Accordingly, in accordance with one of the preferred embodiments, the coke reducing additive composition of the present invention is suitable for reducing fouling caused due to deposits of coke products on walls of the processing unit during pyrolytic or cracking processing of a plastic material, or a feedstock, or a combination of the plastic material and the feedstock.

Accordingly, in sixth embodiment, the present invention relates to a method for reducing fouling caused due to deposits of coke products on walls of the processing unit, wherein the method comprises a step of treating a plastic material, or a feedstock, or a combination of the plastic material and the feedstock contained in the processing unit with the coke reducing additive composition of the present invention.

In accordance with the second, third, fourth, fifth or sixth embodiment of the present invention, the coke reducing additive composition comprises at least a combination of:

a) diisodecyl phenyl phosphite (DIDPP); and b) metal salt including calcium salt, sodium salt, calcium salt of organic acid, sodium salt of organic acid or a mixture thereof:

wherein the calcium salt is calcium naphthanate (CaNaphthenate);

wherein the sodium salt is Sodium naphthanate (NaNaphthenate).

In accordance with the second, third, fourth, fifth or sixth embodiment of the present invention, the plastic material comprises a waste plastic material, olefin polymer (OP) material, polypropylene plastic (PP) material, or a combination thereof.

In accordance with the second, third, fourth, fifth or sixth embodiment of the present invention, the feedstock comprises a vacuum residue (VR).

In accordance with one of the embodiments of the present invention, the olefin polymer (OP) includes a polymer made from monomers. For example, the olefin polymer (OP) includes a polymer made from, without limitation, ethylene, propylene, butane, butadiene. The olefin polymer (OP) may be prepared by any known polymerisation method, which may preferably be either a ziegler process or a free radical process.

In accordance with one of the embodiments of the present invention, the coke reducing additive composition of the present invention may comprise: component (a) diisodecyl phenyl phosphite (DIDPP), and component (b) metal salt including calcium salt, sodium salt, calcium salt of organic acid, sodium salt of organic acid or a mixture thereof, wherein the calcium salt is calcium naphthanate (CaNaphthenate), and wherein the sodium salt is sodium naphthanate (NaNaphthenate) in equal amounts or in any other weight ratio preferably varying from about 0.1 to 99.9 to about 99.9 to 0.1 (percent by weight).

In accordance with one of the embodiments of the present invention, the coke reducing additive composition of the present invention may be added to a processing unit for processing the plastic material, or the feedstock, or the combination of the plastic material and the feedstock in an amount varying from about 1 ppm to about 5000 ppm, preferably in an amount varying from about 5 ppm to about 3000 ppm, more preferably in an amount varying from about 5 ppm to about 2000 ppm, even more preferably in an amount varying from about 5 ppm to about 1000 ppm, more preferably in an amount varying from about 5 ppm to about 500 ppm, and such amount may vary as per amounts of the plastic material, the feedstock, or the combination of the plastic material and the feedstock being processed.

As per one of the embodiments of the present invention, the present invention may be applied to any processing unit, coker unit, pyrolysis furnace, or steam cracking furnace processing any amount of the plastic material, or the feedstock, or the combination of the plastic material and the feedstock. However, as per one of the embodiments, the weight ratio of the feedstock to the plastic material, that is, of the vacuum residue (VR) to the olefin polymer (OP) may vary between about 0.1 to 99.9 to about 99.9 to 0.1.

As per one of the embodiments of the present invention, the present invention may be applied to any processing unit, coker unit, pyrolysis furnace, or steam cracking furnace processing the plastic material with or without the feedstock.

Feedstock

It may be noted that the scope of present invention may not be limited by the feedstock or a composition thereof.

However, in accordance with one of the embodiments of the present invention, the feedstock of the above-described embodiments is a hydrocarbon feedstock.

In accordance with one of the preferred embodiments of the present invention, the feedstock may be selected from the group comprising crude oil, vacuum residue, atmospheric residue, asphalted pitch, shale oil, coal tar, clarified oil, residual oils, heavy waxy distillates, foots oil, slop oil or mixture thereof.

In accordance with one of the more preferred embodiments of the present invention, the feedstock is a vacuum residue feedstock.

In accordance with one of the even more preferred embodiments of the present invention, the feedstock is a vacuum residue feedstock comprising asphaltene.

Plastic Material

It may be noted that the scope of present invention may not be limited by the selection of a plastic material.

However, in accordance with one of the embodiments of the present invention, the plastic material of the above-described embodiments may be selected from a group comprising a waste plastic material, an olefin polymer (OP), a low-density polyethylene (LDPE), a high-density polyethylene (HDPE), a mix plastic, a polystyrene, a polypropylene plastic (PP) material, a polyethylene, or a mixture thereof.

In accordance with one of the preferred embodiments of the present invention, the plastic material is a waste plastic material, an olefin polymer (OP), or a mixture thereof.

In accordance with one of the more preferred embodiments of the present invention, the olefin polymer (OP) includes a polypropylene plastic (PP) material.

In accordance with one of the more preferred embodiments of the present invention, the waste plastic material includes a packaging material.

Olefin Polymer (OP)

In accordance with one of the embodiments of the present invention, the olefin polymer (OP) of the above-described embodiments includes a polymer made from monomers. For example, the olefin polymer (OP) includes a polymer made from, without limitation, ethylene, propylene, butane, butadiene. The olefin polymer (OP) may be prepared by any known polymerisation method, which may preferably be either a Ziegler process or a free radical process.

Processing Unit:

It may be noted that the scope of present invention may not be limited by the selection of a processing unit.

However, in accordance with one of the embodiments of the present invention, the processing unit of the above-described embodiments may be a pyrolytic furnace, a Coker unit, a Micro-Coker reactor, a steam cracking furnace, or any furnace for pyrolysis of a feedstock.

Amount of Coke Reducing Additive

In accordance with one of the embodiments of the present invention, the amount of the coke reducing additive of the present invention may vary as per amounts of the feedstock and the plastic material being processed.

In accordance with one of the preferred embodiments of the present invention, the coke reducing additive of the present invention may be added to a processing unit for processing the feedstock, the plastic material, or the feedstock in the presence of a plastic material, preferably for processing the vacuum residue in the presence of an olefin polymer (OP) including the polypropylene plastic material in an amount selected from the group comprising:

a) about 1 ppm to about 5000 ppm,
b) about 5 ppm to about 3000 ppm,
c) about 5 ppm to about 2000 ppm,
d) about 5 ppm to about 1000 ppm, or
e) about 5 ppm to about 500 ppm.

Amount of Feedstock and Plastic Material

In accordance with the present invention, its scope may not be limited to the amount of the feedstock and the plastic material, because the present invention may be applied to any processing unit processing any amount of the feedstock, or the plastic material, or the feedstock in the presence of the plastic material.

However, in accordance with one of the embodiments of the present invention, the feedstock, preferably the vacuum residue and the plastic material, preferably the olefin polymer (OP) may be added or mixed in a weight ratio of the feedstock to the plastic material varying from about 0.1 to 99.9 to about 99.9 to 0.1.

It may be noted that as per the present invention, the pyrolysis includes thermal pyrolysis, hydrocracking or cracking of a feedstock.

It may be noted that as per the present invention, the amount referred in the present invention including the Tables may be referred to as in "wt. %" or "% by wt.".

It may be noted that as per one of the embodiments of the present invention, the terms "comprises" and "comprising", respectively may also be interpreted as "includes" and "including" or as "consists" and "consisting".

Further technical advantages of the present invention would be apparent from the accompanying examples, which are for the illustration purpose and not intended to limit scope of the present invention.

EXAMPLES

In the following examples, the vacuum residue (VR) and the olefin polymer (OP) including polypropylene plastic (PP) material are charged individually and in combination thereof into a reactor of a coker unit. For a blank example, no additive; and for an invention example, a coke reducing additive composition of the present invention comprising a combination of: calcium naphthanate (CaNaphthenate) and diisodecyl phenyl phosphite (DIDPP) in is added. As an exemplary embodiment, the DIDPP and CaNaphthenate were taken in a wt. % (percent by weight) ratio of 9:1. The composition and the coke evaluated for each of the Examples 1-7 are given in the following Table-I.

As one of the exemplary embodiments, the experiments are carried out as follows:

The temperature of the reactor is raised to greater than about 600 deg C. and inner temperature within the reactor is maintained between about 440-500 deg C. during the course of reaction. A transfer tube facilitating passage of volatile lower boilers (<about 370 deg C.) into the collectors for liquid distillates and gaseous fractions is maintained at 245 deg C., during the experiment. Typical reaction or run time is maintained at about 4 h under stirring at about 200 rpm. Post reaction or run, the reactor is cooled to about 140 deg C., and liquid distillate is analyzed by Pyr-GC, coke from various parts of the reactor evaluated by CHNS and VCM analysis and the gas fraction quantified.

For experimental results, a reference may be drawn to the experimental data presented in the following table: Table-I, which are not intended to limit the scope of the present invention.

TABLE I

| | Composition | | | Result | | | |
|---|---|---|---|---|---|---|---|
| Expt. No. | VR (g) | PP (g) | Additive A * (ppm) | Distillate (g) | Coke (g) | Gas (g) | Total (%) |
| 1 (Comparative) | 100 | Nil | Nil | 42 | 38.37 | 19.61 | 99.98 |
| 2 (Comparative) | Nil | 100 | Nil | 85.4 | 0.9 | 13.62 | 99.92 |
| 3 (Invention composition) | Nil | 100 | 25 | 88.28 | 0.7 | 11.02 | 100.00 |
| 4 (Invention composition) | 100 | Nil | 25 | 44.5 | 37.1 | 18.4 | 100.00 |
| 5 (Comparative) | 50 | 50 | Nil | 54.59 | 29.76 | 15.64 | 99.99 |
| 6 (Invention composition) | 50 | 50 | 50 | 58.97 | 26.11 | 14.92 | 100.00 |
| 7 (Invention composition) | 50 | 50 | 75 | 59.04 | 22.99 | 17.98 | 100.01 |

* Additive A is a combination of: calcium naphthanate (CaNaphthenate) and diisodecyl phenyl phosphite (DIDPP)

Technical Advantages of the Invention

As can be observed from comparative Expt. 1, the amount of coke formed on pyrolysis of vacuum residue (VR) is substantially high 38.37 g, and the amount of distillate formed is substantially low 42 g, and as per comparative Expt. 2, the amount of coke formed on pyrolysis of polypropylene plastic material (PP) is substantially low 0.9 g, and the amount of distillate formed is substantially high 85.4 g. However, as per the invention Expt. 3 with addition of the additive composition of the present invention, the amount of coke formed on pyrolysis of polypropylene plastic material (PP) is substantially further reduced to 0.7 g, and the amount of distillate formed is substantially further increased to 88.28 g as compared to the Expt. No. 2. Similarly, as per the invention Expt. 4 with addition of the additive composition of the present invention, the amount of coke formed on pyrolysis of vacuum residue (VR) is further reduced to 37.1 g, and the amount of distillate formed is further increased to 44.5 g as compared to the Expt. No. 1.

Therefore, the invention Expt. No. 3 and the invention Expt. No. 4 demonstrate synergistic effect of the presently provided composition, and also demonstrate surprising and unexpected technical advantages of the presently provided composition to further reduce the coke formation and to further increase the distillate formation.

As can be observed from comparative Expt. No. 5, the amount of coke formed on pyrolysis of combination of vacuum residue (VR) and polypropylene plastic material (PP) in 1:1 weight ratio is high 29.76 g, and the amount of distillate formed is low 54.59 g. However, as per the invention Expt. No. 6 and Expt. No. 7, the amount of coke formed on pyrolysis of combination of vacuum residue (VR) and polypropylene plastic material (PP) in 1:1 weight ratio with addition of the additive composition of the present invention is reduced to 26.11 g and 22.99 g respectively, and the amount of distillate formed is increased to 58.97 g and 59.04 g respectively as compared to the comparative Expt. No. 5. These experiments also demonstrate synergistic effect of the presently provided composition, and also demonstrate surprising and unexpected technical advantages of the presently provided composition to further reduce the coke formation and to further increase the distillate formation.

Based on the above-discussed experimental results of the present invention, the inventors, without being bound by the theory or the mechanism, have found that the coke reducing additive composition of the present invention has provided a solution to the existing problems of the industry to reduce formation of coke and simultaneously to increase distillate formation.

Therefore, the present invention has been found to have a technical advantage of simultaneously: reducing formation of coke and increasing formation of distillate during the processing of a plastic material comprising a waste plastic material, an olefin polymer (OP), a low-density polyethylene (LDPE), a high-density polyethylene (HDPE), a mix plastic, a polystyrene, a polypropylene, a polyethylene, or a mixture thereof.

Therefore, the present invention has been found to have a technical advantage of simultaneously: reducing formation of coke and increasing formation of distillate during the processing of a feedstock comprising crude oil, vacuum residue, atmospheric residue, asphalted pitch, shale oil, coal tar, clarified oil, residual oils, heavy waxy distillates, foots oil, slop oil, or mixture thereof.

Therefore, the present invention has been found to have a technical advantage of simultaneously: reducing formation of coke and increasing formation of distillate during the processing of a plastic material along with a feedstock, wherein the plastic material comprises a waste plastic material, an olefin polymer (OP), a low-density polyethylene (LDPE), a high-density polyethylene (HDPE), a mix plastic, a polystyrene, a polypropylene plastic (PP), a polyethylene, or a mixture thereof; and wherein the feedstock comprises crude oil, vacuum residue (VR), atmospheric residue, asphalted pitch, shale oil, coal tar, clarified oil, residual oils, heavy waxy distillates, foots oil, slop oil, or mixture thereof.

Therefore, the present invention has been found to have a technical advantage of converting a waste plastic material to a distillate (a useful chemical commodity) during pyrolytic or cracking processing of the waste plastic material.

Therefore, the present invention has been found to have a technical advantage of reducing formation of coke deposits on walls of a processing unit during pyrolytic or cracking processing of a plastic material, or a feedstock, or a combination of the plastic material and the feedstock.

Therefore, the present invention has been found to have a technical advantage of reducing fouling caused due to deposits of coke products on walls of the processing unit during pyrolytic or cracking processing of a plastic material, or a feedstock, or a combination of the plastic material and the feedstock.

The invention claimed is:

1. A coke reducing additive composition for simultaneously:

reducing coke formed and increasing yield of distillate formed during processing of a plastic material, or a feedstock, or a combination of a plastic material and a feedstock in a processing unit, wherein the coke reducing additive composition comprises at least a combination of:

(a) diisodecyl phenyl phosphite (DIDPP); and (b) metal salt including calcium salt, sodium salt, calcium salt of organic acid, sodium salt of organic acid or a mixture thereof, wherein the calcium salt is calcium naphthenate (CaNaphthenate); and wherein the sodium salt is Sodium naphthenate (NaNaphthenate).

2. The composition as claimed in claim 1, wherein the plastic material comprises a waste plastic material, an olefin polymer (OP), a low-density polyethylene (LDPE), a high-density polyethylene (HDPE), a mix plastic, a polystyrene, a polypropylene plastic (PP), a polyethylene, or a mixture thereof.

3. The composition as claimed in claim 1, wherein the feedstock comprises crude oil, vacuum residue, atmospheric residue, asphalted pitch, shale oil, coal tar, clarified oil, residual oils, heavy waxy distillates, foots oil, slop oil, or mixture thereof.

4. The composition as claimed in claim 1, wherein the component (a) and the component (b) are present in equal amounts.

5. The composition as claimed in claim 1, wherein the component (a) and the component (b) are present in a weight ratio varying from about 0.1 to 99.9 to about 99.9 to 0.1 (percent by weight).

6. The composition as claimed in claim 1, wherein the additive composition is added to the processing unit in an amount varying from about 1 ppm to about 5000 ppm.

7. A method for simultaneously: reducing coke formed and increasing distillate formed during processing of a plastic material, or a feedstock, or a combination of a plastic material and a feedstock in a processing unit, wherein the method comprises a step of adding the coke reducing additive composition as claimed in claim 1 in a processing unit containing the plastic material, or the feedstock, or the combination of the plastic material and the feedstock.

8. A method for using a coke reducing additive composition for simultaneously: reducing coke formed and increasing distillate formed during processing of a plastic material, or a feedstock, or a combination of a plastic material and a feedstock in a processing unit, wherein the method comprises a step of treating the plastic material, or the feedstock, or the combination of the plastic material and the feedstock contained in the processing unit with the coke reducing additive composition as claimed in claim 1.

9. A method for converting a waste plastic material to a distillate, wherein the method comprises a step of treating a plastic material, or a feedstock, or a combination of the plastic material and the feedstock contained in a processing unit with the coke reducing additive composition as claimed in claim 1.

10. A method for reducing formation of coke deposits on walls of a processing unit, wherein the method comprises a step of adding to a plastic material, or a feedstock, or a combination of the plastic material and the feedstock contained in the processing unit the coke reducing additive composition as claimed in claim 1.

11. A method for reducing fouling caused due to deposits of coke products on walls of a processing unit, wherein the method comprises a step of treating a plastic material, or a feedstock, or a combination of the plastic material and the feedstock contained in the processing unit with the coke reducing additive composition as claimed in claim 1.

12. The composition as claimed in claim 1, wherein the plastic material comprises a waste plastic material, an olefin polymer (OP), polypropylene plastic (PP) material.

13. The composition as claimed in claim 1, wherein the feedstock comprises a vacuum residue (VR).

14. The composition as claimed in claim 1, wherein the additive composition is added to the processing unit in an amount varying from about 5 ppm to about 3000 ppm.

15. The composition as claimed in claim 1, wherein the additive composition is added to the processing unit in an amount varying from about 5 ppm to about 2000 ppm.

16. The composition as claimed in claim 1, wherein the additive composition is added to the processing unit in an amount varying from about 5 ppm to about 1000 ppm.

17. The composition as claimed in claim 1, wherein the additive composition is added to the processing unit in an amount varying from about 5 ppm to about 500 ppm.

* * * * *